United States Patent [19]

Padovani

[11] 3,935,357

[45] Jan. 27, 1975

[54] HOLLOW EXTRUDED PLASTIC STRIPS FOR PACKINGS

[75] Inventor: Pietro Padovani, Verona, Italy

[73] Assignee: I. S. A. P. S.p.A., Verona, Italy

[22] Filed: Mar. 27, 1973

[21] Appl. No.: 345,415

[52] U.S. Cl. ..... 428/166; 206/521; 264/209; 428/178; 428/188

[51] Int. Cl.[2] ..... B32B 3/02; B32B 3/26; B29D 23/04; B65D 81/02

[58] Field of Search..... 161/139, 122, 127; 264/173, 209, 177 R; 206/522–523, 521; 428/166, 178, 188

[56] References Cited

UNITED STATES PATENTS

| | | | |
|---|---|---|---|
| 1,968,447 | 7/1934 | Hardesty | 264/209 X |
| 2,674,433 | 4/1954 | Mautner | 206/521 X |
| 2,748,401 | 6/1956 | Winstead | 161/139 UX |
| 3,274,315 | 9/1966 | Kawamura | 264/209 X |
| 3,509,005 | 4/1970 | Hartig | 161/139 X |
| 3,589,972 | 6/1971 | Greig et al. | 161/122 X |
| 3,664,906 | 5/1972 | Hartig | 161/139 X |
| 3,812,230 | 5/1974 | Takahashi | 264/177 R |

FOREIGN PATENTS OR APPLICATIONS

| | | | |
|---|---|---|---|
| 1,228,399 | 11/1966 | Germany | 264/209 |

*Primary Examiner*—Philip Dier
*Attorney, Agent, or Firm*—Sughrue, Rothwell, Mion, Zinn & Macpeak

[57] ABSTRACT

An elongated shape or strip from which packing cases may be made is formed as a hollow section of plastic material, the secton having outer walls and inner interconnecting and strengthening walls. The general form of the section may be flat, rectangular, polygonal or triangular, and the inner and outer walls may be of differing thicknesses. Preferably the outer sides of the shape are smooth or curved, and a packing case may use several different sections, all of plastic material or some of wood or metal.

2 Claims, 11 Drawing Figures

HOLLOW EXTRUDED PLASTIC STRIPS FOR PACKINGS

This invention relates to hollow extruded shapes in plastic material, to be utilized in place of and/or associated with elements made out of wood, wood pulp, papier-mache, cardboard or metal for making packing cases.

Hollow elements extruded in the form of sheets of plastic material are known, which have passages between an upper wall and a lower one. The side walls of the passages, together with the upper and lower walls, constitute the supporting structure of the sheet. Such sheets, sheared in strips of, e.g., 3–5 cm width, form the basis of packings, such as crates or cages to contain various products, predominantly vegetables, flowers or fruit, which are fragile. Such strips, either sheared or sawn, have hollow and very sharp sides, which cause damage to the products contained in the crates or cages. Furthermore, such strips are easily subject to deformation or buckling, thus imparing the packings' solidity and safety. Such strips due to shearing or sawing, are particularly weak near their sides, where squashing, buckling or bending may easily occur.

Attempts have been also made to obtain strips from such hollow elements in extruded sheet plastic material, by means of hot-shearing, with a view to making strips with sealed sides. Such strips also tend to present the same drawbacks as the strips described above when obtained by cold-shearing or sawing. Hot-shearing or hot-welding of the sides of cold-shearing or cold-sawn strips, distorts the molecular orientation of the strips in near their sides. While the general molecular orientation of the strips is lengthwise, at the sides a distortion of this molecular orientation is obtained, the molecules extending normal to the general direction prevailing in the strips. This produces buckling and bending of the strips subjected to light axial loads. Both processes and equipment for manufacturing the above described strips are laborious and expensive. Moreover, strips of such type must have walls of considerable thickness, in order to be suited to bear the loads they may be subjected to. This increases their weight and, consequently, their cost.

An object of the present invention is to provide hollow extruded shapes in plastic material, to be uitlized in place of and/or associated with elements made out of wood, wood pulp, paper-mache, cardboard or metal, the resultant packings having none of the drawbacks above mentioned.

Another object of the invention is to provide packings completely or partially made up of hollow extruded shapes in plastic material.

According to the present invention there is therefore provided a hollow extruded shape made of plastic material with; outside walls and internal longitudinal reinforcing walls; a cross section with an external convex-polygonal profile with closed sides; curved edges; and a homogeneous molecular orientation of said plastic material in the longitudinal direction of said strip.

Due to the homogeneous molecular orientation existing throughout the shapes made by this invention, the inside reinforcing walls may be very thin.

The hollow extruded shapes of the present invention may have different forms. Particularly these hollow extruded shapes may be in the form of laterally closed flat strips, of suitable dimensions, in which the larger outside walls are flat and substantially parallel and the other smaller walls are free from sharp edges and have a curved surface.

Hollow shapes according to this invention can be easily prepared with equipment well known to those skilled in the Art, including an extruder for extruding thermoplastic materials, provided with a suitably modified die head, as well as devices for handling and cooling the extruded shapes thus obtained.

Out of the wide range of thermoplastic materials, which may be used for preparing the extruded shapes according to this invention, the following ones may be cited by way of illustrative, but not limitative, example: polyolefins, among which polyethylene and polypropylene; polystyrene, and styrene copolymers of various kinds.

It is possible for the manufacturers of packing cases to order extruded shapes according to this invention and also the wooden parts, directly from the factory, this enabling them to prepare the cases in a quick and inexpensive way, in their warehouses, and to immediately fill them with the products such cases are intended to carry.

Reference is now made to the accompanying drawings, in which.

Figure 1:
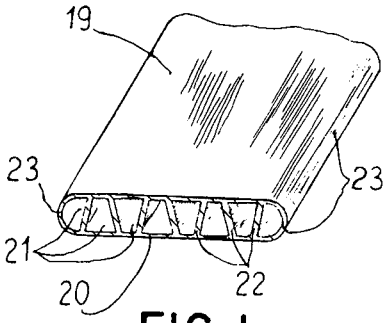

The attached drawings are of different scales, and equivalent parts have like numerical indices. In FIG. 1 the extruded shape is in the form of a flat strip and includes two outside walls, an upper one 19 and a lower one 20, between which walls passages 21 are formed by means of inner walls 22.

The inner walls 22, together with the curved ends 23, are so formed and have such a homogeneous molecular orientation of the ends, and of the zones in proximity to the sides that the strip can readily bear high loads imposed on the walls 19–20, even when thin walls 22 are used; a very rigid structure is thus obtained, which cannot damage the products contained in the crates even if the shapes are of small thickness, for example 0.2–0.4 mm.

Figure 2:
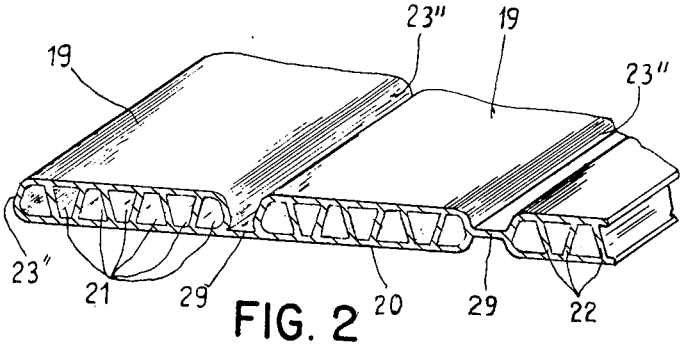

FIG. 2 shows hollow extruded shapes in the form of strips connected by fins 29; each of such strips consists of an upper wall 19 and a lower wall 20, between which passages 21 are formed by means of inside walls 22. The fins 29 ensure a uniform feed of the strips during their extrusion and facilitate their subsequent handling.

Though the fins can be separated from the extruded shapes by a number of methods, it is preferable to shear them before they are thoroughly cooled, in order not to distort the molecular orientation of the shapes' sides. This substantially prevents structural deformations which would reduce the strength of the strips.

Though not clear from the figure, it is evident that the fins may be of very small width; therefore, to separate the shapes from one another, it is sufficient to shear at the centre line of each fin, leaving the separated parts attached to the shapes, which thus have a reinforcing rib, whose sharp edge is located in such a way as not to damage the product to be contained in the subsequent packing case.

The employment of connecting fins between the shapes during extrusion ensures that the strips remain in alignment during the cooling down of the extruded shapes.

Figure 3:
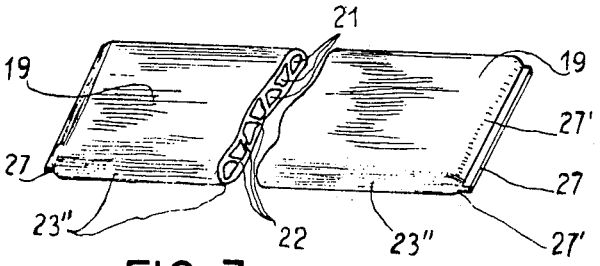
FIG. 3 shows a centre-sectioned perspective view of an extruded flat strip with closed ends.

FIG. 3 represents an extruded shape in the form of a flat strip with passages 21 and inside reinforcing walls 22 similar to those of FIG. 1, with closed ends 27 thinner than the strip.

Such ends 27 are connected by means of curve walls 27', with upper wall 19 and lower wall 20 of the strip, these walls being also connected by curvilinear side walls 23''.

Such a shape due to its closed ends is well suited to bear axial stresses, its inside being provided with air tight chambers.

Figure 4:
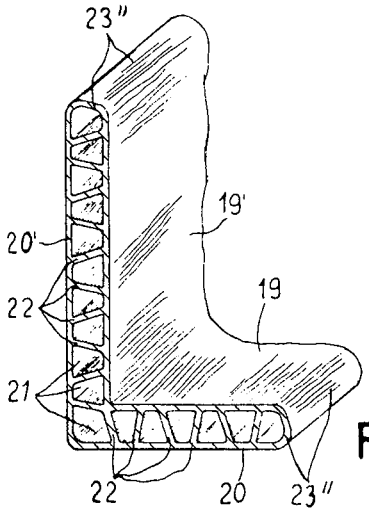
FIGS. 1, 2, 4 and 5 represent perspective part sectional views of extruded shapes respectively in form of a flat strip, of an angle strip, and of a prism, all with open ends.

FIG. 4 represents an extruded shape in the form of an angle strip of L-form, with outside walls 19–19' and 20–20'. This shape is provided with passages 21 having walls 22, and terminates, at the free ends of its sides, with curvilinear sidewalls 23''. The limbs of said extruded L-shape may be of equal or different width as represented by FIG. 4, and may be used as side or end members of crates, such for instance as the one shown in FIG. 11.

By using the same L-shape with limbs of different width, it is possible to produce crates having side-walls of two different heights, receiving one or two layers of products, according to requirements. Such extruded L-shapes can be prepared separately from one another or connected by fins which are subsequently removed without altering the homogeneous molecular orientation of the L shape. The angle between the limbs may be 10° and 160°.

Figure 5:
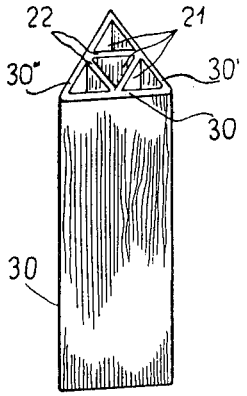

FIG. 5 represents an extruded shape in the form of a triangular prism section; this is utilized as a corner stanchion of crates or cages. The side-walls 30–30'–30'' of this shape enclose passages 21 of triangular section separated by walls 22 acting as supports. Said passages 21 may also have a polygonal section.

Such stanchions can be extruded separately from one another, or connected by fins subsequently removable from the stanchions in the same way as described for the extruded shapes in form of flat or angle strips.

One of the passages 21 of the stanchion may serve to house the stems of pressure pins, as explained hereinafter.

Figure 11:
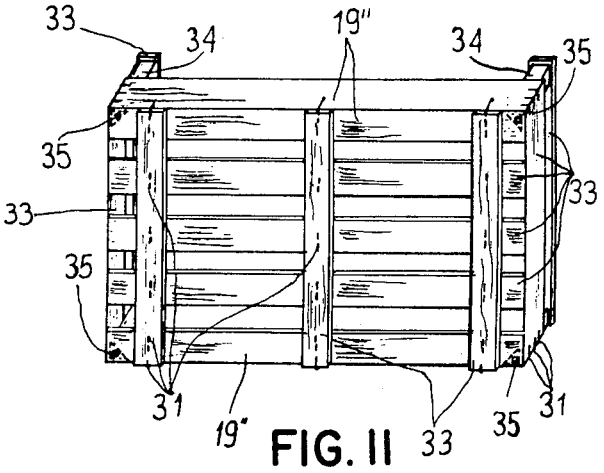

By assembling four corner stanchions like those of FIG. 5, with two extruded L-shapes like those of FIG. 4, and with one or more extruded shapes in form of flat strips for each head, the skeleton of a crate is obtained, which can then be completed by utilizing further extruded shapes in the form of flat strips, as shown in FIG. 11, where 31 indicates metal fasteners, 33 the flat strips, 19'' the extruded L-shapes, 34 the stanchions like that of FIG. 5, and 35 pressure pins, whose stems, gripping one another, pass through the central passage of stanchions 34.

The various elements constituting a crate can be fastened to one another by metal fasteners, by welding, or by gluing agents; they can be provided with recessings to facilitate assembly by welding or by gluing; they may also present holes to simplify assembly by means of pressure pins.

Figure 6:
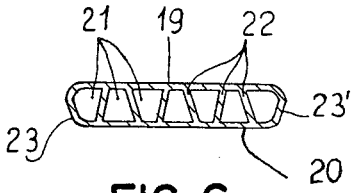
FIGS. 6, 7 and 8 represent end views of the open ends of some types of extruded flat strips.

FIG. 6 shows an end view of an open ended extruded shape in the form of a flat strip, in which side walls 23' have a curved surface different from that of the strip of FIG. 1, in the sense that said side walls 23' terminate the outside (end) passages of the strip, so that they assume an approximately trapezoidal section, but without being capable of damaging any products which may come into contact with the side walls.

Figure 7:
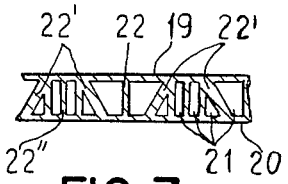

FIG. 7 shows a view of an open ended extruded shape in the form of a flat strip, in which passages 21 are present, some of which are of triangular section, others trapezoidal and others quadrangular; such a structure shows that the passages' sections may have different configurations.

In FIG. 7, the walls 22' are thicker than the remaining walls of the passages. It is evident, however, that embodiments are possible using supports having the same thickness as the upper wall 19 or lower wall 20. Alternatively the thicknesses of the walls 22'' normal to the upper and lower walls 19–20 of the strip can be increased.

FIG. 7 does not show the strip sides, which are free from sharp edges, and curved, with a homogeneous molecular orientation with respect to the whole strip.

It is clear that the thickening of walls 22' or 22'' can be achieved in particular parts of the width of a strip in order to increase its resistance to axial or torsional stress, this directly depending, of course, on the thicknesses of the passage walls and on the height, length and width of the extruded strip.

Figure 8:
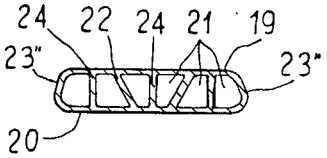

FIG. 8 shows a front view of an open ended extruded shape in the form of a flat strip, in which passages 21 have a trapezium section, and a wall 24, normal walls 19–20 of the strip, while walls 22 constitute supports between the walls 19–20. The sides 23'' are similar to the sides 23' in FIG. 6. One or more outside or inside walls of the extruded shapes can be thicker than the remaining walls. It is also evident that, it is possible to make extruded shapes with a central rib thickened along the mean longitudinal axis, as well as extruded shapes with two stiffening ribs each arranged near the sides, or extruded shapes having only the sides thickened with respect to the other walls of the passages, provided that the molecular orientation is homogeneous throughout and parallel to the longitudinal axis of the strip.

The extruded shapes illustrated in FIGS. 1 to 8, can be utilized for manufacturing crates and cages using both plastic material and wood, or consisting of elements of plastic material only.

Figure 9:
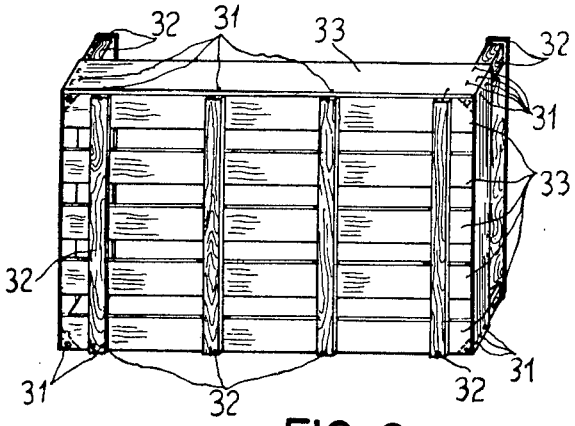
FIGS. 9, 10 and 11 show crates, partly or wholly made from extruded shapes according to this invention.

Extruded shapes of the invention can be assembled with one another or with wooden stanchions by means of metal fasteners, as shown in FIG. 9, where the metal fasteners are marked 31, the wooden elements 32 and the extruded strips in plastic material with 33.

Figure 10:
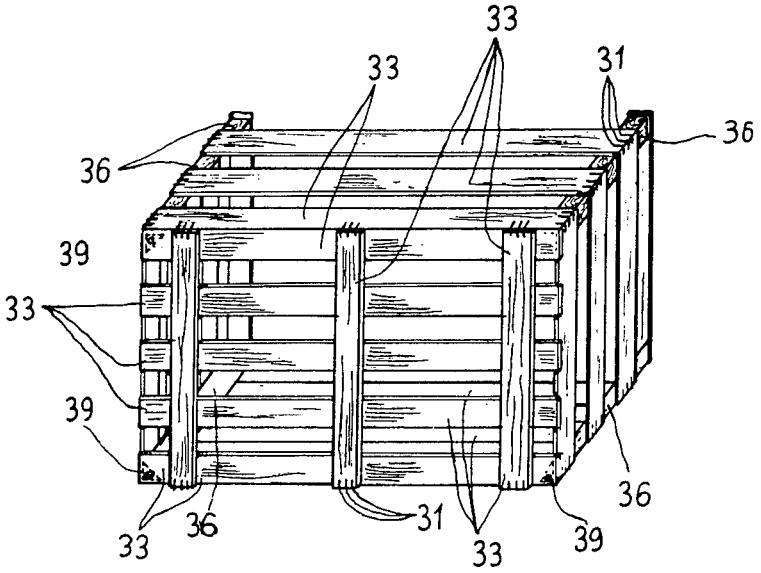

FIG. 10 represents a crate prepared from plastic material extruded shapes in the form of flat strips 33, using metal fasteners 31 which fix the strips on wooden stanchions 36. The lower ends of such wooden stanchions are fixed to strips 33 by means of pins 39.

I claim:

1. A hollow extruded strip having at least one end, made of plastic material comprising an outer wall forming a closed triangular shape when viewed in cross-section taken transverse to the longitudinal axis of the strip, and a plurality of inner walls parallel to the longitudinal axis of the strip, formed integral with and connecting opposed portions of said outer wall, wherein the homogeneous molecular orientation of said plastic material in the longitudinal direction of said strip.

2. A hollow extruded strip made of plastic material comprising a plurality of outer walls, each outer wall forming a closed geometrical shape when viewed in cross-section taken transverse to the longitudinal axis of said strip; a plurality of inner walls parallel to the longitudinal axis of the strip and formed integral with and connecting opposed portions of each outer wall; and a connecting flange formed intregally with and connecting adjacent outer walls, the homogeneous molecular orientation of said plastic material is in the longitudinal direction of said strip.

* * * * *